US006559855B1

(12) United States Patent
Kawase et al.

(10) Patent No.: US 6,559,855 B1
(45) Date of Patent: May 6, 2003

(54) METHOD FOR TRANSFERRING IMAGE INFORMATION, METHOD FOR UPDATING IMAGE INFORMATION, TRANSFERRING APPARATUS AND UPDATING APPARATUS

(75) Inventors: Kei Kawase, Sagamihara (JP); Takao Moriyama, Yokohama (JP); Fusashi Nakamura, Setagaya-ka (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/300,956

(22) Filed: Apr. 28, 1999

(30) Foreign Application Priority Data

Apr. 28, 1998 (JP) ..... 10-119092

(51) Int. Cl.[7] ..... G09G 5/02
(52) U.S. Cl. ..... 345/596; 345/619; 345/694
(58) Field of Search ..... 345/89, 501, 619, 345/596, 694

(56) References Cited

U.S. PATENT DOCUMENTS

| | | | | |
|---|---|---|---|---|
| 4,796,094 A | * | 1/1989 | Van Dorsselaer | 358/3.2 |
| 5,629,717 A | | 5/1997 | Netsu | |
| 5,642,439 A | * | 6/1997 | Sato et al. | 382/254 |
| 5,712,651 A | | 1/1998 | Tomiyasu | |
| 5,726,677 A | | 3/1998 | Imamura | |
| 5,732,151 A | * | 3/1998 | Moon et al. | 382/167 |

FOREIGN PATENT DOCUMENTS

| | | |
|---|---|---|
| JP | 55-135469 | 10/1980 |
| JP | 61-41182 | 2/1986 |
| JP | 4-86190 | 3/1992 |
| JP | 5-241548 | 9/1993 |
| JP | 5-244439 | 9/1993 |
| JP | 5-284368 | 10/1993 |
| JP | 6-22303 | 1/1994 |
| JP | 8-179740 | 7/1996 |

* cited by examiner

*Primary Examiner*—Matthew C. Bella
*Assistant Examiner*—Mackly Monestime
(74) *Attorney, Agent, or Firm*—Scully, Scott, Murphy & Presser; Kevin M. Jordan, Esq.

(57) ABSTRACT

The present invention enables image information of high resolution to be transferred via a transmission line with limited band width using a simple configuration. In transferring image information between a main body of a computer and a display, a dither matrix is used to update images stored in the display. That is, a plurality of blocks whose size is of a predetermined dither matrix are defined in an image, and information of each pixel in each block is transferred to the display in order of a value of a corresponding element in the dither matrix. Transfer of unchanged pixel data can be omitted. In addition, in transferring image information between the main body of the computer and the display, image information stored in the computer is divided into a plurality of blocks, for each of which the number of changed pixels or the number of writings to pixels in the block is calculated so that image information in blocks which exceed a predetermined number is transferred to the display block by block.

31 Claims, 7 Drawing Sheets

METHOD FOR TRANSFERRING IMAGE INFORMATION, METHOD FOR UPDATING IMAGE INFORMATION, TRANSFERRING APPARATUS AND UPDATING APPARATUS

BACKGROUND OF THE INVENTION

1. Technical Field

The present invention relates to a method for transferring image information.

2. Prior Art

Following techniques have been employed: to equip both of a main body of a computer and a display device with a storage device storing image information, to communicate between them if image information stored in the storage device in the main body of the computer is updated by the main body of the computer and to limit data transferred from the main body of the computer to an updated portion, and to refresh displayed content on the display device with image information stored in the storage device in the display device. For instance, U.S. Pat. No. 5,726,677 discloses that VRAM of the main body of the computer is connected to RAM in an X driver of an LCD module via a special bus and if data of the VRAM is updated, the updated portion is transferred via the special bus. This patent does not disclose any detailed method for transferring the data from the VRAM to the RAM in the X driver of the LCD module.

Japanese Unexamined Patent Application No. Hei 8-179740 discloses that the image generation side thins out and transmits graded data from the frame memory according to a predetermined rule and the image display side stores part of graded data which comprises a preceding image frame based on the rule to complement the transmitted graded data with the stored graded data. For instance, on the image generation side, if high order bit data of the graded data of the preceding image frame is identical, a signal representing the identity and low order bit data are transferred, and if it is not identical, a signal representing the non-identity and high order bit data are transferred. Meanwhile, on the image display side, high order bit data of the preceding image frame is stored, and the graded data is complemented by transmitted low order bit data and stored high order bit data if the signal representing the identity is received, and the graded data is complemented by transmitted high order bit data plus preset constant data as low order bit data if the signal representing the non-identity is received.

Another technique to transfer image information divided into several frames has been employed. Japanese Unexamined Patent Application No. Hei 4-86190 discloses that source data for display is thinned out at every predetermined number n and read out and then transferred. For instance, it is disclosed that every one of n lines are transferred and the transmission speed is 1/n.

Furthermore, Japanese Unexamined Patent Application No. Hei 6-22303 discloses that a frame is divided into a plurality of subframe areas and only divided single frame area is transmitted for each frame with thinning out. This allows a plurality of subframes to reproduce the original single frame, to decrease the load on the display side by transferring only changed portions (differences) between frames as well as significantly reducing transmission capacity. In addition, transmission volume is further reduced by using a compression. However, the transmitting and receiving sides must execute more complicated processing.

Meanwhile, there exists a technology called gradation emulation. It does not represent a plurality of gradation levels in a single frame but represents them over a plurality of frames, often using a dither pattern. For instance, U.S. Pat. No. 5,712,651 discloses that it comprises 16 dither matrixes corresponding to 16 levels of gradation. In addition, in order to prevent flickers on the display screen, a dither matrix is provided for each frame. At gradation level 1, 16 dither patterns corresponding to the frames 1 to 16 are provided, one dot of which lights up. In this patent, dither matrixes are used for gradation emulation and not for updating image information stored in the display.

Also, with regard to a ferrodielectric liquid crystal display, there exists a technology to check, when partial writing to a display memory occurs, the number of displayed lines whose display data was changed by the partial writing and to write partially to the ferrodielectric liquid crystal display only if the number of changed lines is equal to or less than a predetermined number (for instance, U.S. Pat. No. 5,629,717/Japanese Patent Publication No. 2617345). This technology is a specific technology to ferrodielectric liquid crystal displays.

Furthermore, also with regard to ferrodielectric liquid crystal displays, there exists a technology comprising a flag memory which represents whether or not each line was rewritten and a flag counter which calculates the number of flags of the flag memory on the full screen, wherein the full screen is refreshed if the number of the flags is up to one, and partial rewriting is performed if it is between two and four, and the full screen is refreshed if it is equal to or more than five (for instance, Japanese Unexamined Patent Publication No. Hei 5-241528). This patent also describes that some lines may not be refreshed if a partial rewriting mode continues, in which case the threshold is to be changed. This technology is also specific to ferrodielectric liquid crystal displays.

As seen in the above background arts, there is none in which a dither matrix is used for updating images stored in a display device in transferring image information between the main body of a computer and the display device. In addition, it is not mentioned that, also in transferring image information between the main body of a computer and the display device, the image information stored in the main body of a computer is divided into a plurality of blocks, the number of pixels whose data is changed or rewritten is counted for each block, and the image information in blocks exceeding a predetermined number is transferred to the display device block by block.

Thus, an object of the present invention is to enable transfer of image information of high resolution via a transmission line with limited width by using a simple mechanism.

In addition, another object of the present invention is to enable more natural display of image information transferred via a transmission line with limited band width by using a simple mechanism.

In addition, still another object of the present invention is to reduce power consumption and unnecessary radiation by lowering transmission rate of image information.

SUMMARY OF THE INVENTION

The present invention is to be handled as follows. If first image information which is stored in a first apparatus and comprises a plurality of pixels is transferred to a second apparatus in order to update second image information stored in the second apparatus, following steps are performed: defining a plurality of blocks in the first image information, wherein each block has a size of a predetermined dither matrix; and transferring each pixel information in each block to the second apparatus in order of a value of a corresponding element of the dither matrix. By transferring in order of a value of a corresponding element in the dither matrix, it becomes possible to transfer image information of high resolution even if the transmission line has low band width and to update and display image information in a natural form in the second apparatus. Moreover, it is also possible to put each pixel an order of transfer before transferring and to transfer them in that order thereafter.

The second aspect of the present invention is as follows. That is, if image information which is stored in a first apparatus and comprises a plurality of pixels is transferred to a second apparatus, wherein the pixels are divided into blocks, and each block has a size of a predetermined dither matrix, following steps are performed: determining, in order of a value of a corresponding element in the dither matrix, whether each pixel in each block of the image information should be transferred to the second apparatus; and transferring information of the pixels which are determined to be transferred in the order to the second apparatus. In this way, it is possible to avoid information transfer of unnecessary pixels, whereby the amount of transferring data is reduced. It may further include a step of changing a bit which corresponds to image information of a pixel changed by the first apparatus and represents whether the pixel is changed or not (written or not) to a state of changed (written).

In this case, the first apparatus may have a bit representing whether there is a writing to the pixel for each pixel, and the above determining step may include a step of referring to the bit of the pixel to be determined. It is also possible to include a bit representing whether there is a change, not writing, and a step of referring to the bit.

If there is information of pixels not to be transferred, it further includes a step of transferring to the second apparatus information representing whether each pixel is transferred or not. This information representing whether each pixel is transferred or not may be "1" in case of transferring bit by bit, and "0" in case of not transferring. In addition, this information representing whether each pixel is transferred or not may be a bitmap of the entire image information, a bitmap of pixels in the same order in different blocks, a run length of pixels included in the same line among the pixels in the same order as above in different blocks. Note information representing whether each pixel is transferred or not can be shared with information representing whether the pixel is changed or written.

Furthermore, it is also possible to include a step of performing, in said first apparatus, a processing for moving a portion of the image information to another part in the image information; and a step of transferring to the second apparatus a command for performing the same processing for moving. In this way, it is possible to reduce the amount of data to be transferred, which is less than changed pixels. In this case, a following step may be further included: a step of moving the content of bits which correspond to the moved portion of the image information, each of which represents whether a change (writing) of a pixel is made, to a position for another portion of the image information in bits, each of which represents whether a change (writing) of a pixel is made. It is also possible to include a step of determining whether a pixel to be transferred is included in a group comprising one or a plurality of the blocks; and if it is determined that no pixel is to be transferred, skipping the step of determining whether each pixel in each block of the image information and the subsequent steps for a predetermined pixel in the group. In this way, the amount of transferring data may be further reduced.

The step of determining whether a pixel to be transferred is included in a group may comprise a step of referring to a bit for each group, wherein the bit represents whether a pixel in the group is updated by the first apparatus.

The third aspect of the present invention is as follows. That is, if image information which is stored in a first apparatus and comprises a plurality of pixels is transferred to a second apparatus, wherein the plurality of pixels is divided into blocks, and each block has a size of a predetermined dither matrix, following steps are performed: holding change information representing whether content of each pixel in the image information is changed; determining, in order of a value of a corresponding element in the dither matrix, whether each pixel in each block of the image information should be transferred to the second apparatus, by referring to the change information; and transferring the pixels which are determined to be transferred in the order to the second apparatus.

If the second image information stored in the second apparatus which receives the transmitted information is updated, following steps are performed: receiving information of each pixel in each block of the first image information in order of a value of a corresponding element in the dither matrix; and updating information of a corresponding pixel in the second image information with information of each pixel received. The second image information is updated in order of receipt, but the order in which the display screen is refreshed in the second apparatus may be asynchronous with the order in which it is updated.

If by using first image information which is stored in a first apparatus and comprises a plurality of pixels divided into blocks, each of which block has a size of a predetermined dither matrix, second image information stored in a second apparatus is updated, following steps are performed: receiving information of each pixel in each block of the first image information, except information not transferred from the first apparatus, in order of a value of a corresponding element in the dither matrix; and updating information of a corresponding pixel in the second image information with information of each pixel received. As it is received in order of a value of a corresponding element in the dither matrix, when the second image information is updated, consequently the display screen of the second apparatus is refreshed in a visually natural way.

The above receiving step includes a step of receiving information representing whether or not each pixel is transferred to synchronize with the first apparatus of the transmitting end.

It is also possible to further include a step of receiving a command for moving a portion of the second image information to another portion in the second image information and a step of moving a portion of the second image information to another portion in the second image information according to the command.

It is also possible that groups which comprises one or a plurality of blocks are defined and the above receiving step include a step of receiving information representing which groups information of transferred pixels belongs to. Because the amount of transferring data is further reduced, it is intended to grasp which pixel's information has been transferred to exactly update the second information.

The fourth aspect of the present invention is as follows: That is, if image information comprising a plurality of pixels stored in a first apparatus and divided into a plurality of blocks is transferred to a second apparatus, following steps are performed:

counting the number of changed pixels for each block; determining for each block whether the count exceeded a predetermined threshold; and if the count of a block exceeded the predetermined threshold, transferring to the second apparatus, information of the pixels belonging to the block. According to this fourth aspect, any change of a pixel made by the first apparatus is not immediately transferred to the second apparatus. In the event that the number of pixels which are changed is small, however, the impact on the second apparatus is slight, and even if a change of an influential scale is made, there is no problem because the transfer is made by the block.

The fifth aspect of the present invention is a method for transferring image information comprising a plurality of pixels stored in a first apparatus and divided into a plurality of blocks, to a second apparatus. The method comprises the steps of:

counting the number of writings to pixels for each block; determining for each block whether the count exceeded a predetermined threshold; and if the count of a block exceeded the predetermined threshold, transferring to said second apparatus, information of the pixels belonging to the block. In this case, it is determined based on a writing, not a change. The change is counted only in the event of writing information different from previous one on the same pixel, while even a writing of the same information is counted in case of a writing. Theoretically it should be based on changes rather than writings, but there is a drawback that detecting changes requires great load.

If the count is determined not to have exceeded the predetermined threshold, it is possible to increment the count. This is for the purpose of preventing the situation where the count value does not exceed a predetermined threshold no matter how often the count value of a certain block is checked and the screen is never updated. That is, it must be transferred by the block at least once in several times.

While the above describes the present invention as processes, it is possible to implement the present invention by an apparatus which perform these processes or to create a program which causes a computer to perform these processes. This program is typically stored on storage medium such as a floppy-disk and a CD-ROM or any other form of storage device.

BRIEF DESCRIPTION OF THE DRAWINGS

Preferred embodiments of the present invention will now be described by way of example only, with reference to the accompanying drawings in which.

DETAILED DESCRIPTION OF THE PREFERRED EMBODIMENTS OF THE INVENTION

Figure 1:
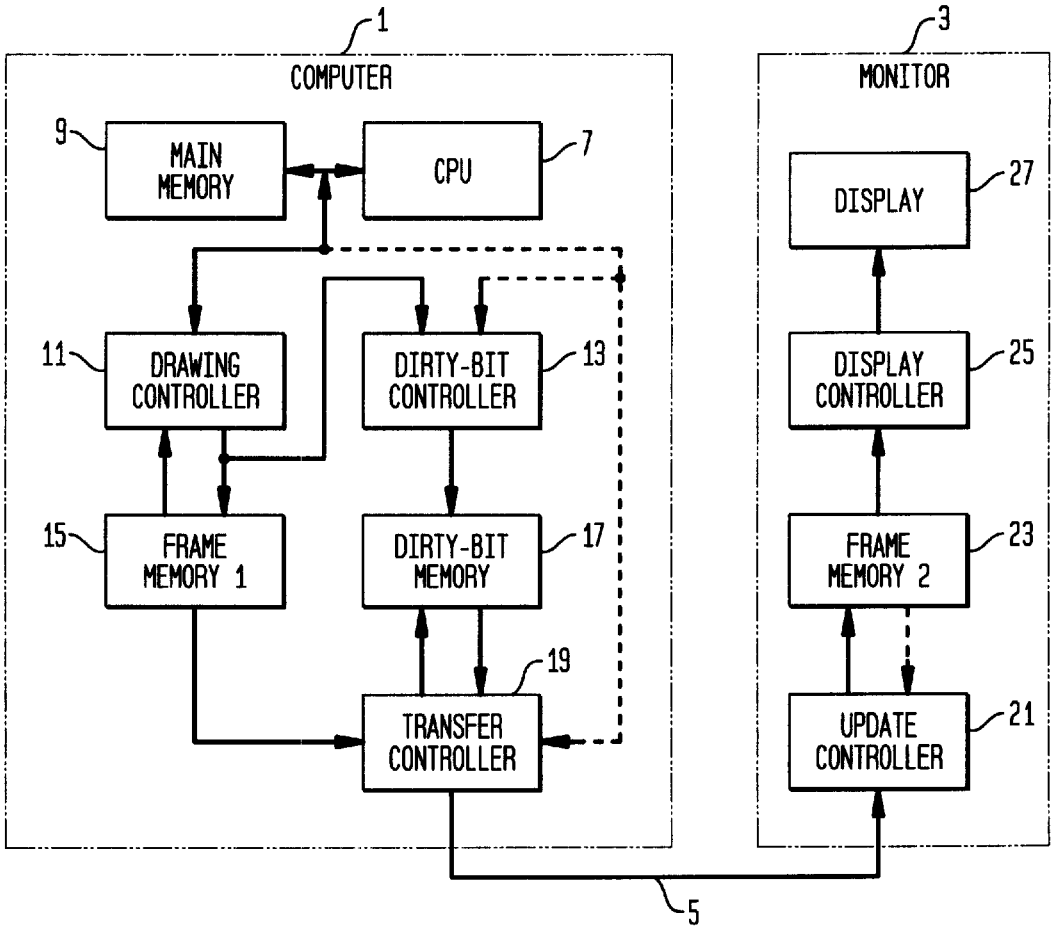
FIG. 1 is a functional block diagram of Embodiment 1 of the present invention.

FIG. 1 shows a configuration according to the present invention. A computer 1 is connected to a monitor 3 via a transmission line 5. The computer 1 comprises a CPU 7, a main memory 9, a drawing controller 11, a frame memory 1 (15), a dirty-bit controller 13, a dirty-bit memory 17 and a transfer controller 19. On the other hand, the monitor 3 comprises an update controller 21, a frame memory 2 (23), a display controller 25 and a display 27. For instance, suppose the display 27 is a display device of high resolution such as 1600×1200 or 2048×1536 pixels, and the transmission line 5 has only band width which does not allow data of all pixels to be transferred in vertical scanning period (about 60 Hz) of such display 27. Technically it is possible to provide a transmission line 5 of high speed, but it will raise transmission cost significantly. Therefore, the present invention reduces this transmission cost and enables transmission of high resolution images. The dotted line in FIG. 1 represents that indirect control is possible.

The CPU 7 performs processing by means of the main memory 9. In the event of drawing on the display 27 of the monitor 3, CPU 7 outputs drawing command to the drawing controller 11. The drawing controller 11 reads necessary data from the frame memory 1 (15) and writes data to the frame memory 1 (15). The frame memory 1 (15) stores data of pixels generated by the drawing controller 11. The dirty-bit memory 17 also stores information for recording writings or changes corresponding to each pixel of the frame memory 1 (15). The dirty-bit controller 13 determines writings to or changes of the content of pixels in the frame memory 1 (15) by monitoring writings to the frame memory 11 of the drawing controller 13 and sets up corresponding dirty-bits.

It is assumed to explain the present invention that the dirty-bit memory 17 represents "0" as a status of no writing or change and "1" as a status of written or changed. However, it can be the opposite. As mentioned above, transition from 0 to 1 can be made by either whether there is a writing to a pixel or whether content of a pixel is changed. If it is determined based on whether there is a writing to a pixel, there will be a drawback that even if the same content is written, the dirty-bit shifts from 0 to 1. However, configuration of a circuit becomes simple since it can determine just because there is a writing. On the other hand, if it is determined based on whether there is a change to content of a pixel, it will shift from 0 to 1 in the event that the value is different from the pixel value before writing. In this case, it is efficient because a dirty-bit is not set and the amount of data to be transferred can be reduced if the same value is written. However, it has a drawback that an action of Read-Modify-Write (it may be Read-Compare-and-conditional-write) is always required and besides, a comparator is necessary. Nevertheless, performance of the frame buffer 1 (15) is usually designed to withstand Read-Modify-Write so that the substantial difference is whether there is a comparator, which supposedly does not make implementation of the latter too burdensome.

The transfer controller 19 outputs data of pixels in the frame memory 1 (15) via the transmission line 5 to the monitor 3. In doing so, it refers to the dirty-bit memory 17. It transfers data of pixels corresponding to bits storing "1" in the dirty-bit memory 7. However, there is a problem of what order each pixel is transferred in. This embodiment uses a dither matrix. Namely, a plurality of pixels in the frame memory 1 (15) are divided into a plurality of blocks whose size is of a dither matrix, and in the block, the transfer controller 19 transfers, in order of a value of an element in the dither matrix, data of a corresponding pixel. The transfer controller 19 has the dither matrix, and the dither matrix is as follows, for instance.

$$D = \begin{bmatrix} 0 & 8 & 2 & 10 \\ 12 & 4 & 14 & 6 \\ 3 & 11 & 1 & 9 \\ 15 & 7 & 13 & 5 \end{bmatrix} \quad \text{[Expression 1]}$$

Figure 8:
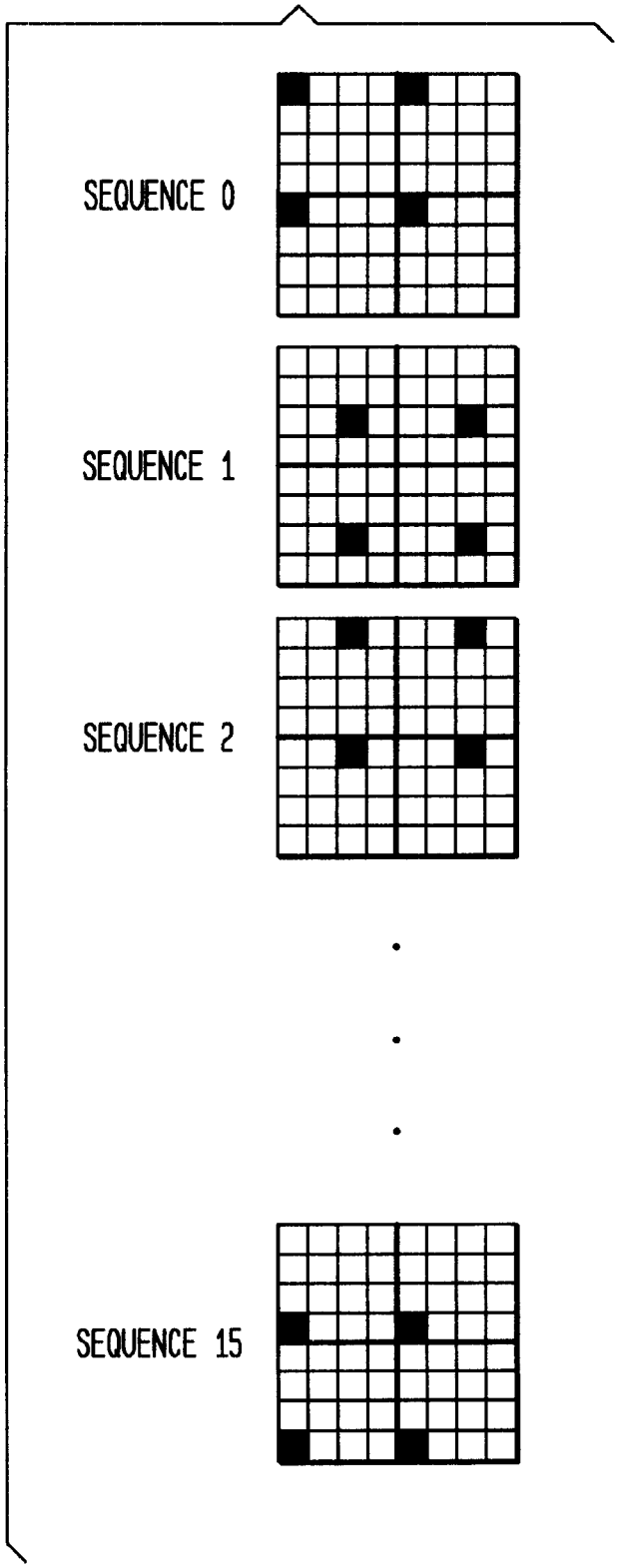
FIG. 8 is a diagram showing transferred data of Embodiment 1 of the present invention.

As the numbers 0 to 15 are put in each matrix element of the dither matrix one by one, every pixel data is taken out in the order of the value of the corresponding matrix element (See FIG. 8. The pixels painted black are transferred in a frame). Since each matrix element's value is evenly distributed as seen in Expression 1, even when writings or changes to the frame memory 1 (15) by the drawing controller 11 are so much that written or changed data of pixels cannot be transferred at once in the transmission line 5, an untransferable portion does not concentrate so that it does not stand out on the display 27.

Now, a processing flow of the transfer controller 19 is explained by a pseudocode shown below.

TABLE 1

```
10:     loop:
20:       for ( i=0; i<16; i++ ) {
30:         for ( Y=0; Y<Ymax; Y+=4) {
40:           for ( X=0; X<Xmax; X+=4) {
50:             Regarding a pixel corresponding to the
position of the dither matrix element with
value equal to i in a block containing a pixel
(X, Y) :
60:             if (Dirty-bit=1) {
70:               send ('1') ; /*represents that pixel data
                    follows*/
80:             send(Pixel);
90:             Dirty-bit=0;
100:          } else {
110:            send ('0') ; /*represents that no pixel data
                    follows*/
120:          }
130:        }
140:      }
150:    }
160: goto loop:
```

The pseudocode of Table 1 assumes that the dither matrix is 4×4. However, the size of the dither matrix is not limited to this. The loop in line 10 is to repeat up to line 160, and may be a free run in this case. The i in line 20 is the element value of the dither matrix. The initial value is 0 and repeats up to line 150 until it becomes i=15. Each time it repeats, 1 is added to i. Line 30 defines a repetition about Y coordinate value Y of a pixel, and line 30 to line 140 are repeated until Y becomes Ymax which is Y's maximum value. As the size of the dither matrix is 4×4, 4 is added at each repetition. Line 40 defines a repetition about X coordinate value X of a pixel, and line 40 to line 130 are repeated until X becomes Xmax which is X's maximum value. As in the case of Y, 4 is added at each repetition. While (X, Y) is represented by coordinate of a pixel, it is also possible to assign unique numbers to every blocks corresponding to the dither matrix and perform repetitions by the block's coordinate value.

Line 60 to line 110 are performed for the pixel of the position equal to the dither matrix element i of the block containing the pixel (X, Y). In line 60, the bit in the dirty-bit memory 17 corresponding to the pixel to be examined is referred to so that it is determined whether a dirty-bit is set (Dirty-bit=1). If there is any change or a writing made, "1" is transferred in line 70 since it is Dirty-bit=1. It is an example, however, to inform the monitor 3 that pixel data is transferred thereafter. Then the pixel data is transferred to the monitor 3 (line 80). The dirty-bit is cleared by making it Dirty-bit=0 (line 90). In this way, unless a change or a writing is made by the time the transfer controller 19 reexamines this pixel, this pixel is not transferred. On the other hand, as it is not necessary to transfer it in the event of Dirty-bit=0, the bit "0" which represents that no pixel data is transferred is transferred to the monitor 3.

By repeating this, the pixel data stored in the frame memory 1 (15) is transferred in each block in order of a value of an element in the dither matrix. However, any data not to be updated is not transferred.

In the pseudocode of Table 1, a bit representing whether or not pixel data is transferred is transferred in lines 70 and 110. This is substitutable, for instance, by initially transferring all the data of the dirty-bit memory 17 to the monitor 3. It can also be transferred all together for each i. In this case, for instance, corresponding bits are collected from the dirty-bit memory 17 before line 30, and a bitmap of 1/16 of all the pixels is made and transferred to the monitor 3. In addition, it is also possible to create a run length from a line of a pixel with an equal Y value among the same i's and transfer it.

Furthermore, several dither matrixes are grouped together so that not only a dirty-bit for each pixel but a dirty-bit for each group is also stored in the dirty-bit memory 17. If it is confirmed that there is no dirty-bit set in the group, processing of line 50 to line 110 in the pseudocode of Table 1 is omitted as regards pixels in the group. In this way, processing speed is further increased. The following shows processing of the transfer controller 19 in such a case in the pseudocode. Moreover, the above block is called a macro block and employs a macro block whose size is 128×128 pixels.

TABLE 2

```
200: loop
210:   for ( i=0; i<16; i++ ) {
220:     for ( YB=0; YB<YBmax; YB+=1) {
230:       for ( XB=0; XB<XBmax; XB+=1) {
240:         Execute the following if there is a change of
               macro block (XB, YB)
250:         {
260:         send (XB, YB, i) ; /*transfers i and macro
block's                 position*/
270:         for ( Y=YB*128; Y<(YB+1) *128; Y+=4) {
280:           for ( X=XB*128; X<(XB+1) *128; X+=4) {
290:             Regarding a pixel of a position equal to
the                   dither matrix element i of the
block                       containing (X, Y) :
300:               if (Dirty-bit=1) {
310:                 send ("1");
                       /*represents that pixel data
follows*/
320:                 send (Pixel) ;
330:                 Dirty-bit=0;
340:               } else {
350:               send ('0') ;
                   /*represents that no pixel data
follows*/
360:               }
370:             }
380:           }
390:         }
```

TABLE 2-continued

```
400:        } /*end for regarding change of macro block*/
410:     }
420:  }
430: goto loop;
```

The difference between the pseudocode of Table 1 and the pseudocode of Table 2 is substantially represented between line 220 and line 260. Here, the macro block's address is incremented, and if it is found that there is a dirty-bit set in the macro block, information of the macro block's position and i are transferred to the monitor 3, and lines 50 to 110 of Table 1 are implemented for the blocks in the macro block.

A macro block in this case is the size of a dither matrix multiplied by an integer, and especially exponentiation of 2, but this invention is not limited to this. Also, while a macro block of one layer is defined on the blocks of the dither matrix, it is also possible to define two or more layers of macro blocks. In such a case, if it is confirmed that there is no dirty-bit set in a macro block of higher order, it is no longer necessary to examine macro blocks of lower order than that.

It is necessary to consider the characteristics of operation of the drawing controller 11 in order to reduce the necessary band width in the transmission line 5. As the desktop environment using the graphical user interface is mainstream today, scrolling of the sub-region of the screen is often used. Even if the drawing controller 11 detects a command to move a rectangular area output by the CPU 7, it does not process the command until all writings to the frame memory 1 (15) by drawing commands preceding this command are executed. However, the drawing controller 11 notifies the transfer controller 19 and the dirty-bit controller 13 of receipt of the command to move, and the transfer controller 19 suspends the processing of Table 1 or Table 2. In response to completion of the processing of the preceding drawing command, the drawing controller 11 reads out the rectangular area on the frame memory 1 (15) and writes the rectangular area on another location on the frame memory 1 (15). At this time, the dirty-bit controller 13 does not set up dirty-bits against writings on the frame memory 1 (15) due to the command to move the rectangular area. After this, the transfer controller 19 transfers to an update controller 21 of the monitor 3 a command which instructs the update controller 21 to perform the same operation (including the position and size of where the rectangular area moves from and the position which it moves to). Also, the dirty-bit controller 13 moves dirty-bits corresponding to the pixels in the original rectangular area to the position corresponding to the pixels in the rectangular area of destination. There should be no conflict arising from this. After that, the transfer controller 19 resumes the processing of Table 1 or Table 2.

Figure 2:
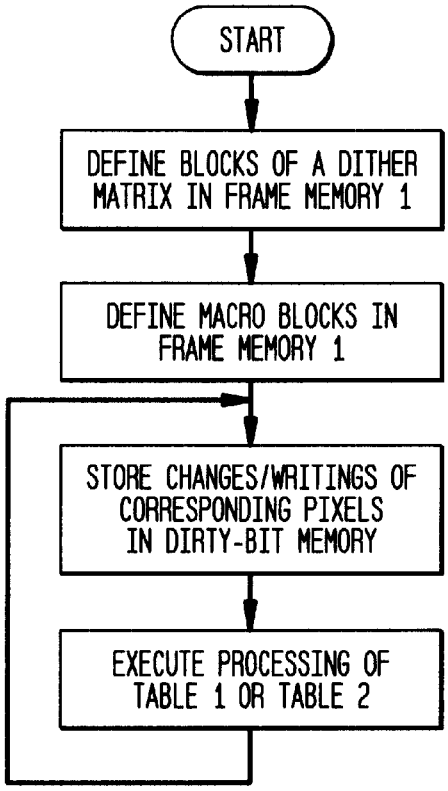
FIG. 2 is a flowchart of the processing on the transmitting end of Embodiment 1 of the present invention.
Figure 3:
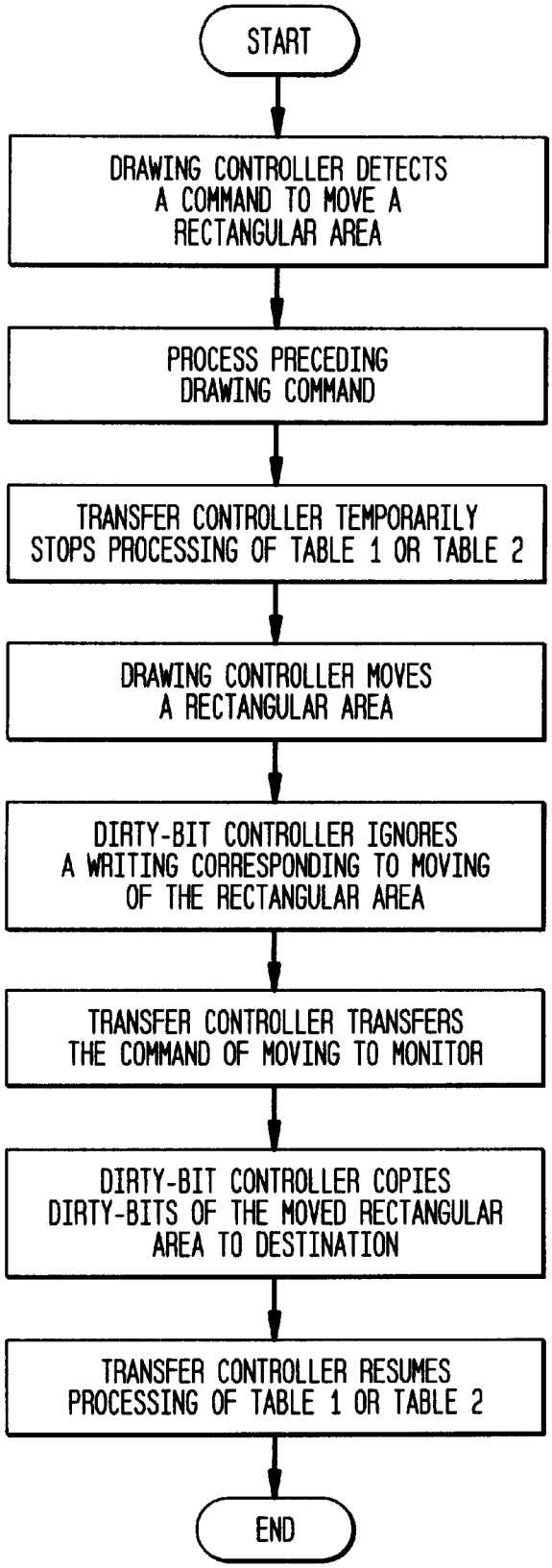
FIG. 3 is a flowchart representing the processing of a transformed example (a portion) on the transmitting end of Embodiment 1 of the present invention.

The above processing flow is summarized in FIG. 2 and FIG. 3. While data of a pixel with a dirty-bit set is transferred in the description of Table 1 and Table 2, it is also possible to reduce the necessary band width in the transmission line 5 by transferring it in order of a value of an element in the dither matrix, regardless of whether or not a dirty-bit is set.

Next an operation of the monitor 3 is described. The frame memory 2 (23), the display controller 25 and the display 27 operate in the same way as a display subsystem and a display connected to the usual main body of a computer. Namely, the image information stored in the frame memory 2 (23) is sequentially read by the display controller 25 and output to the display 27. Then, the display 27 displays the image information. The present invention is different from usual as it has the update controller 21 and updates the image information of the frame memory 2 (23) with data received from the transfer controller 19. Especially, since the transfer controller 19 transfers data of a corresponding pixel in order of a value of a element in a dither matrix as shown in Table 1 and Table 2, a correct pixel of the frame buffer 2 (23) must be updated taking the order into consideration. In addition, since the computer 1 side transfers only the ones with a dirty-bit set, they may be skipped in the order of elements in the dither matrix. Moreover, it is further complicated if macro blocks are defined on the computer 1 side. Thus, it is important for the update controller 21 to be synchronized with the transfer controller 19.

Figure 4:
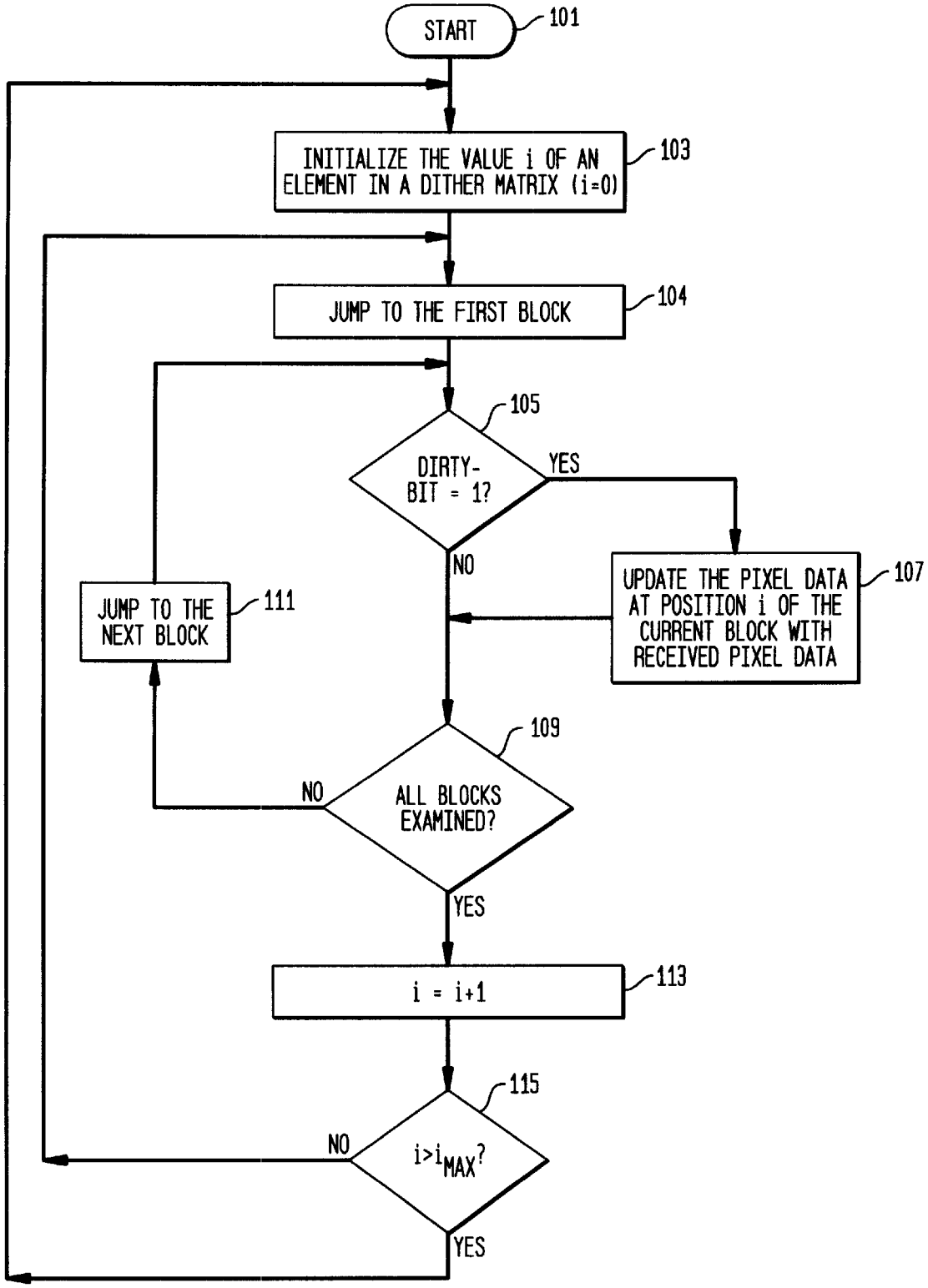
FIG. 4 is a flowchart of the processing on the receiving end of Embodiment 1 of the present invention.

A processing flow of the update controller 21 is explained as follows using FIG. 4 and FIG. 5. FIG. 4 shows the processing in the event that the processing of Table 1 is executed by the transfer controller 19. The computer 1 and the monitor 3 must be initially synchronized. Namely, the transfer controller 19 notifies the update controller 21 of the beginning of transfer. This can be done, for instance, by transferring that the value of the element in the dither matrix is i=0. Then, the value of the element in the dither matrix i is initialized (i=0). Furthermore, it jumps to the first block whose size is of a dither matrix (step 104). Then, it is determined whether the value of the received dirty-bit is 1 (Dirty-bit=1)(step 105). If Dirty-bit=1, pixel data at the position of the current block, i, is updated with the pixel data which is received after the received dirty-bit (step 107). After this step 107 or in the event of Dirty-bit=0, it is determined whether or not all the blocks were processed (step 109). If all the blocks were not processed, it jumps to the next block (step 111). Then it returns to step 105. On the other hand, if all the blocks were processed, i is incremented by 1; (step 113). It is determined whether or not i has exceeded $i_{max}$ (step 115). If i has not exceeded $i_{max}$, it jumps to the first block and repeats from step 105 to step 111. On the other hand, if i has exceeded $i_{max}$, it returns to step 103 and executes processing from the beginning. Thus, the update controller 21 must also have the same dither matrix as that of the transfer controller 19.

Figure 5:
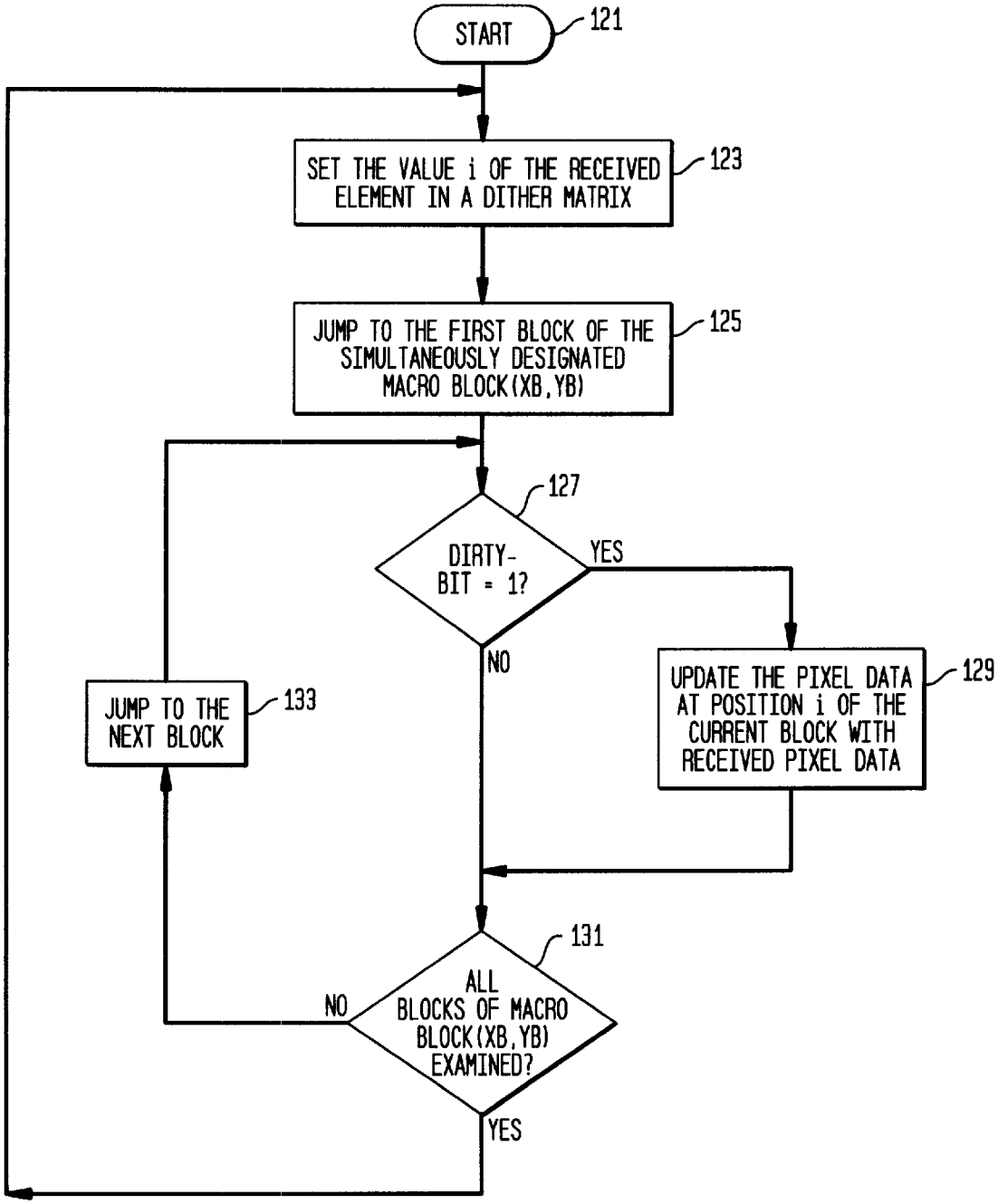
FIG. 5 is a flowchart of the processing on the receiving end (transformation of FIG. 4) of Embodiment 1 of the present invention.

FIG. 5 shows an example of processing to be executed by the update controller 21 if the transfer controller 19 executes the processing of Table 2. In case of Table 2, since the value i of the element in the dither matrix is transferred together with an address of a macro block, the update controller 21 itself does not need to update the value i of the matrix element. However, the configuration of the macro block must be shared by the transfer controller 19 and the update controller 21. Once the transfer controller 19 starts transfer, the update controller 21 sets the received value i of the element in the dither matrix (step 123) and simultaneously jumps to the first block of the designated macro block (XB, YB)(step 125). Then the value of the dirty-bit received next is examined (step 127). If Dirty-bit=1, pixel data at the position of the current block, i, is updated with the pixel data received thereafter (step 129). In case of Dirty-bit=0 or after step 129, it is determined whether all the blocks in the designated macro block (XB, YB) were examined (step 131). If the examination has not been finished yet, it jumps to the next block (step 133). If the examination has been completed, it moves on to processings of the next received i and the macro block (XB, YB).

The processings of the update controller 21 and the display controller 25 are separated, and the updating of the frame memory 2 (23) and the refreshing of the screen are asynchronously performed. That is, the pixels which are used to update the frame memory 2 (23) and the pixels displayed on the screen by immediately following refresh are not always the same, being distributed according to the value of the element in the dither matrix. This makes delay of updating of a refresh memory 2 (23) less conspicuous.

As mentioned in the part of describing the transfer controller 19, it is possible to transfer a corresponding pixel in order of the value of the element in the dither matrix without determining whether a dirty-bit is set. The update controller 21 can deal with this case by making the processing of FIG. 4 simple only if the initial synchronization works. That is, it should be processed always regarding as Dirty-bit=1.

Furthermore, in the event of transferring a command which instructs to move a rectangular area from the transfer controller 19 to the update controller 21, the update controller 21 must be able to perform the same processing. If it is instructed to move a rectangular area as mentioned above, the update controller 21 must have a capability to move a designated rectangular area of a designated address to a designated address. In this case, however, if the update controller 21 has the functions of the drawing controller 11 as they are, it is the same relationship as the drawing controller 11 being instructed from the CPU 7. Therefore, explanation is omitted here.

Figure 6:
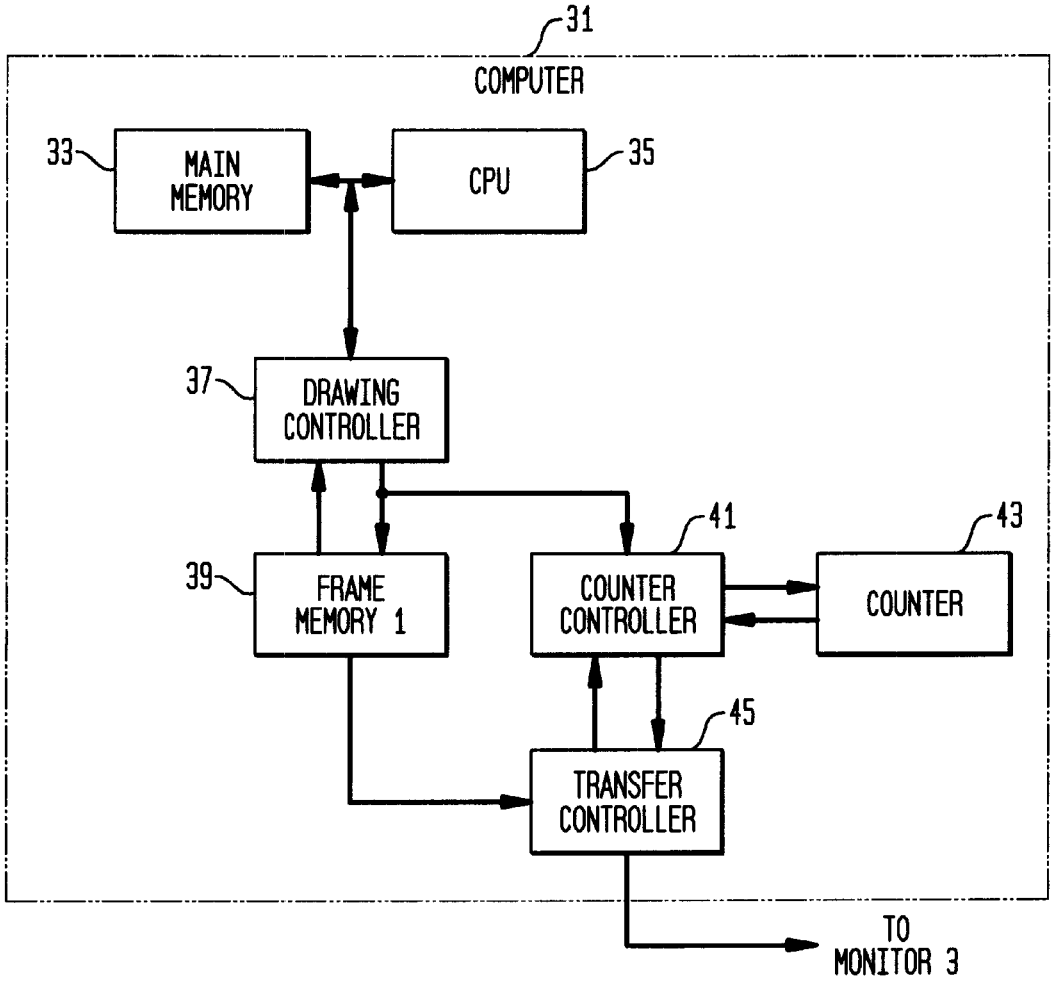
FIG. 6 is a functional block diagram on the transmitting end of Embodiment 2 of the present invention.

Next, a second embodiment is described. A monitor 3 in the second embodiment is omitted here since it is the same as in FIG. 1 as functional block. FIG. 6 shows a functional block diagram of the second embodiment. A computer 31 has a CPU 35, a main memory 33, a drawing controller 37, a frame memory 1 (39), a counter controller 41, a counter 43 and a transfer controller 45. The CPU 35, the main memory 33, the drawing controller 37, and the frame memory 1 (39) have the same functions as the corresponding components in FIG. 1.

Meanwhile, the counter controller 41, the counter 43 and the transfer controller 45 are different from the aforementioned or did not exist. First, as a premise, image information stored in the frame memory 1 (39) is divided into a plurality of rectangular areas (N×M pieces). The counter 43 is set up corresponding to each rectangular area. It means that there exist N×M counters. The counter controller 41 is a controller managing this counter 43, and if a pixel in the rectangular area is written to or changed, it increments the value of the counter corresponding to the rectangular area by 1. If there is a counter which has reached a predetermined threshold, the counter controller 41 notifies the transfer controller 45 of the address of the rectangular area corresponding to the counter and further resets that counter.

Upon receipt of the notification, the transfer controller 45 takes out pixel data in the rectangular area from the frame buffer 1 (39) and outputs it to the monitor 3. It is also possible, however, to process as follows.

TABLE 3

```
500: loop
510:   for ( j=0; j<M; j++ ) {
520:     for ( i=0; i<N; i++ ) {
530:       if ( C (i,j) > C_threshold ) {
540:         send ( Block (i,j) ); /*transfers pixel data
               together with (i,j) */
550:         C (i,j) = 0;
560:       else {
570:         C (i,j) = C (i,j) *C_scale;
580:       }
590:     }
```

TABLE 3-continued

```
600:   }
610: goto loop;
```

The value of the counter corresponding to the address (i,j) of the rectangular area is set as C(i,j). In addition, the thresholds of the counter $C_{threshold}$, and $C_{scale}$ are predetermined constants.

In this Table 3, the transfer controller 45 sequentially scans a counter corresponding to the rectangular area (lines 510 and 520). It determines whether each counter value, C(i,j), exceeds the threshold, $C_{threshold}$, (line 530). If it exceeds the threshold, it transfers pixel data in the rectangular area together with the address (i,j) (line 540). Then it resets the counter value (i,j) of the transferred address (i,j) (line 550). This process can be either ordered by the counter controller 41 or executed by the transfer controller 45 itself. On the other hand, if C(i,j) does not exceed the threshold, $C_{threshold}$, it puts in C(i,j) a value of multiplying the value of C(i,j) by $C_{scale}$ (line 570). This process can also be either ordered by the counter controller 41 or executed by the transfer controller 45 itself. There may arise a rectangular area where the counter value C(i,j) does not reach the threshold no matter how many times the process of the Table 3 is executed. In such a case, updating of the screen may delay, and it is not desirable if the delay lasts long. So, for instance, if it is checked once, the counter value is automatically advanced by multiplying it by $C_{scale}$. Thus, it certainly exceeds the threshold if checked several times, which causes the screen to be updated.

Meanwhile, as to the multiplication by a predetermined number in line 570, it is possible instead either to add a predetermined number to it or to transform it to multiply it by or add to it a predetermined number at every several examinations rather than every time.

It is possible for a condition for incrementing the counter 43 to be either writing to a pixel or changing content of a pixel. Writing to a pixel is very easy to implement because the drawing controller 37 is performing writing and it can be determined by detecting its address. On the other hand, in case of change of pixel content, the load for processing is great because the content before writing must be compared with that after writing.

By configuring as above, it is not transferred at once as to the areas without many writings to or changes of image information, and it is transferred at once as to the areas with many writings to or changes of the image information so that the images in the monitor 3 are refreshed early. By doing so, the necessary band width in the transmission line 5 can be reduced and deterioration of usability can be minimized.

As to a processing of the monitor 3, the processing of the update controller 21 in FIG. 1 is different from Embodiment 1. In Embodiment 2, since the address and pixel data of the rectangular area is transferred in line 540 as shown in Table 3, it is sufficient to write the pixel data as it is to a designated address of the frame memory 2 (23). Needless to say, a partitioned status of the rectangular area must be shared by the monitor 3 and the computer 31.

Figure 7:
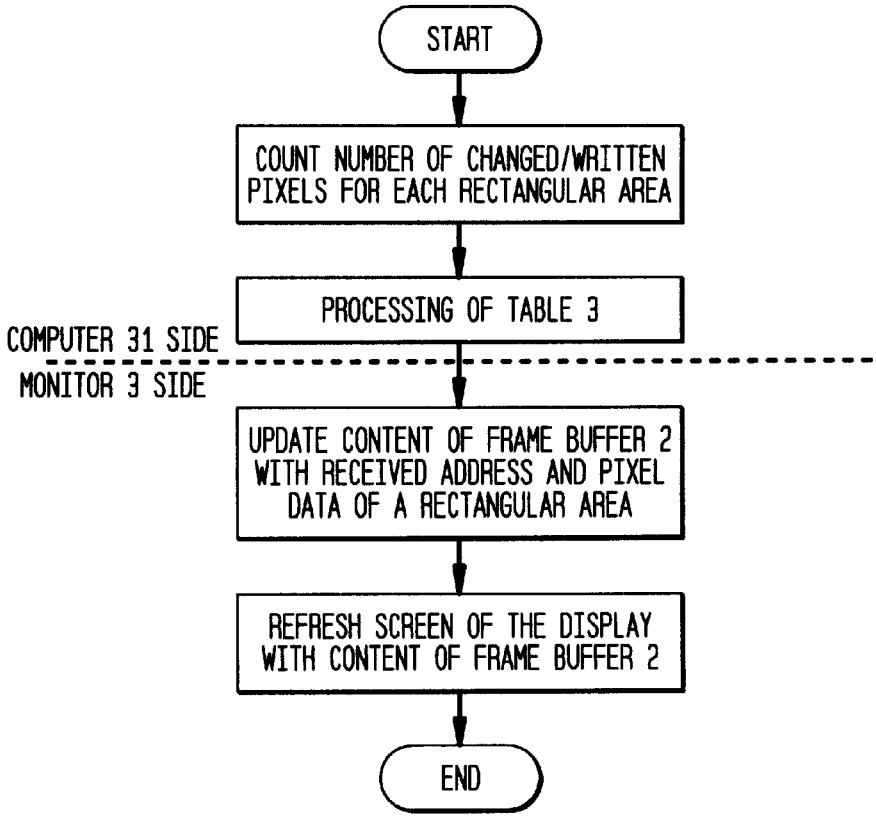
FIG. 7 is a flowchart of the processing of Embodiment 2 of the present invention.

The above processing is summarized in FIG. 7.

The above-mentioned Embodiment 1 and Embodiment 2 are mere examples. Each component of functional block diagrams shown in FIG. 1 and FIG. 6 can either be integrated on one chip or configured with multiple chips. In addition, it is also possible to implement them in a program which implements Table 1 to Table 3 or FIG. 4 and FIG. 5.

The present invention enables image information of high resolution to be transferred via a transmission line with limited band width using a simple configuration. The present invention further enables image information transferred via a transmission line with limited band width using a simple configuration to be displayed in more natural form. By lowering the transmission speed of image information, power consumption and unnecessary radiation could also be reduced.

While the invention has been particularly shown and described with respect to preferred embodiments thereof, it will be understood by those skilled in the art that the foregoing and other changes in form and details may be made therein without departing form the spirit and scope of the invention.

Having thus described our invention, what we claim as new, and desire to secure by Letters Patent:

1. A method for transferring image information which is stored in a first apparatus and comprises a plurality of pixels to a second apparatus, said first apparatus storing a bit for each said pixel representing whether there is a writing to the pixel, said pixels divided into blocks, each said block having a size of a predetermined dither matrix, said method comprising the steps of:

referring to the pixel bit stored in said first apparatus and determining, in an order specified by a pixel order value included in a corresponding element in said dither matrix, whether each pixel in each said block of said image information should be transferred to said second apparatus; and transferring information of said pixels which are determined to be transferred in said order to said second apparatus.

2. A method for transferring image information which is stored in a first apparatus and comprises a plurality of pixels to a second apparatus, said first apparatus storing a bit for each said pixel representing whether there is a change of the pixel content, said pixels divided into blocks, each said block having a size of a predetermined dither matrix, said method comprising the steps of:

referring to the pixel bit stored in said first apparatus and determining, in an order specified by a pixel order value included in a corresponding element in said dither matrix, whether each pixel in each said block of said image information should be transferred to said second apparatus; and transferring information of said pixels which are determined to be transferred in said order to said second apparatus.

3. A method for transferring image information which is stored in a first apparatus and comprises a plurality of pixels, to a second apparatus, said pixels divided into blocks, each said block having a size of a predetermined dither matrix, said method comprising the steps of:

determining, in an order specified by a pixel order value included in a corresponding element in said dither matrix, whether each pixel in each said block of said image information should be transferred to said second apparatus; and transferring information of said pixels which are transferred in said order to said second apparatus, said information representing whether each said pixel is transferred is represented by a run length of the pixels included in the same line among those of the same order in different blocks.

4. A method for transferring image information which is stored in a first apparatus and comprises a plurality of pixels, to a second apparatus, said pixels divided into blocks, each said block having a size of a predetermined dither matrix, said method comprising the steps of:

determining, in an order specified by a pixel order value included in a corresponding element in said dither matrix, whether each pixel in each said block of said image information should be transferred to said second apparatus;

transferring information of said pixels which are determined to be transferred in said order to said second apparatus;

performing, in said first apparatus, a processing for moving a portion of said image information to another part in said image information; and transferring to said second apparatus a command for performing the same processing for moving.

5. The method set forth in claim 4, further comprising a step of moving the content of bits which correspond to the moved portion of said image information, each of which represents whether a change of a pixel is made, to a position for said another portion of said image information in bits, each of which represents whether a change of a pixel is made.

6. A method for transferring image information which is stored in a first apparatus and comprises a plurality of pixels, to a second apparatus, said pixels divided into blocks, each said block having a size of a predetermined dither matrix, said method comprising the steps of:

determining, in an order specified by a pixel order value included in a corresponding element in said dither matrix, whether each pixel in each said block of said image information should be transferred to said second apparatus;

transferring information of said pixels which are determined to be transferred in said order to said second apparatus; and changing a bit which represents whether a change of a pixel is made and corresponds to a pixel of said image information changed by said first apparatus, to a state of changed.

7. A method for transferring image information which is stored in a first apparatus and comprises a plurality of pixels, to a second apparatus, said plurality of pixels divided into blocks, each said block having a size of a predetermined dither matrix, said method comprising the steps of:

holding change information representing whether content of each pixel in said image information is changed;

determining, in order of a value of a corresponding element in said dither matrix, whether each pixel in each said block of said image information should be transferred to said second apparatus, by referring to said change information; and transferring the pixels which are determined to be transferred in said order to said second apparatus.

8. The method set forth in claim 7, further comprising the steps of:

determining whether a pixel to be transferred is included in a group comprising one or a plurality of said blocks; and if it is determined that no pixel is to be transferred, skipping said step of determining whether each pixel in each said block of said image information and the subsequent steps for a predetermined pixel in said group.

9. The method set forth in claim 8, wherein said step of determining whether a pixel to be transferred is included in a group comprises a step of referring to a bit for each said group, said bit representing whether a pixel in said group is updated by said first apparatus.

10. A method for updating, by using first image information which is stored in a first apparatus and comprises a plurality of pixels divided into blocks, each said block having a size of a predetermined dither matrix, second image information stored in a second apparatus, said method comprising the steps of:

receiving information of each pixel in each said block of said first image information, except information not transferred from said first apparatus, in an order specified by a pixel order value included in a corresponding element in said dither matrix;

updating information of a corresponding pixel in said second image information with information of each pixel received; and receiving a command to move a portion of said second image information to another portion in said second image information; and moving said portion of said second image information to said another portion in said second image information according to said command.

11. A method for transferring image information comprising a plurality of pixels stored in a first apparatus and divided into a plurality of blocks, to a second apparatus, said method comprising the steps of:

counting the number of changed pixels for each said block;

determining for each said block whether the count exceeded a predetermined threshold; and if the count of a block exceeded the predetermined threshold, transferring to said second apparatus, information of the pixels belonging to the block.

12. The method set forth in claim 11, further comprising a step of incrementing the count, if said count is determined not to have exceeded said predetermined threshold.

13. A method for transferring image information comprising a plurality of pixels stored in a first apparatus and divided into a plurality of blocks, to a second apparatus, said method comprising the steps of:

counting the number of writings to pixels for each said block;

determining for each said block whether the count exceeded a predetermined threshold; and if the count of a block exceeded the predetermined threshold, transferring to said second apparatus, information of the pixels belonging to the block.

14. The method set forth in claim 13, further comprising a step of incrementing the count, if said count is determined not to have exceeded said predetermined threshold.

15. A transferring apparatus for transferring first image information which comprises a plurality of pixels divided into blocks, to a receiving apparatus in order to update second image information stored in said receiving apparatus, each said block having a size of a dither matrix, said transferring apparatus comprising:

a first storage device for storing said dither matrix;

a second storage device for storing said first image information; and a transmitter for transferring information of each pixel in said each block stored in said second storage device to said receiving apparatus in order of a value of a corresponding element in said dither matrix stored in said first storage device.

16. A transferring apparatus for transferring first image information which comprises a plurality of pixels divided into blocks, to a receiving apparatus, each said block having a size of a dither matrix, said transferring apparatus comprising:

a first storage device for storing said dither matrix;

a second storage device for storing said image information;

a controller for determining whether or not each said pixel in each said block of said image information stored in said second storage device should be transferred to said receiving apparatus in order of a value of a corresponding element in said dither matrix stored in said first storage device; and a transmitter for transferring information of pixels determined to be transferred to said receiving apparatus in said order.

17. The transferring apparatus set forth in claim 16, further comprising a third storage device for storing a bit for each said pixel, which represents whether there is a changed pixel, wherein said controller refers to said bit of a pixel to be determined.

18. The transferring apparatus set forth in claim 16, wherein said transmitter transfers to said receiving apparatus information representing whether or not each pixel is sent.

19. The transferring apparatus set forth in claim 18, wherein said controller performs a process for moving a portion of said image information to another portion in said image information, and said transmitter transfers to said receiving apparatus a command for performing the same process for moving.

20. The transferring apparatus set forth in claim 16, wherein said controller determines whether or not a pixel to be transferred is included in a group comprising one or a plurality of said blocks, and if there is no pixel to be transferred, said controller skips said process of determining whether or not each said pixel in each said block of said image information should be transferred and causes said transmitter to skip the transmission.

21. An updating apparatus for updating, by using first image information which is stored in a first apparatus and comprises a plurality of pixels divided into blocks, second image information, each said block having a size of a dither matrix, said updating apparatus comprising:

a first storage device for storing said second image information;

a second storage device for storing said dither matrix;

a receiver for receiving information of each pixel in each said block of said first image information in order of a value of a corresponding element in said dither matrix stored in said second storage device; and a controller for updating information of a corresponding pixel in said second image information stored in said first storage device with information of each pixel received.

22. An updating apparatus for updating, by using first image information which is stored in a first apparatus and comprises a plurality of pixels divided into blocks, second image information, each said block having a size of a dither matrix, said updating apparatus comprising:

a first storage device for storing said second image information;

a second storage device for storing said dither matrix;

a receiver for receiving information of each pixel in each said block of said first image information, except information not transferred from said first apparatus, in order of a value of a corresponding element in said dither matrix stored in said second storage device; and a controller for updating information of a corresponding pixel in said second image information stored in said first storage device with information of each pixel received.

23. The updating apparatus set forth in claim 22, wherein said receiver receives information representing whether or not each pixel is transferred.

24. The updating apparatus set forth in claim 22, wherein said receiver receives a command for moving a portion of said second image information to another portion in said second image information; and said controller moves said portion of said second image information to said another portion in said second image information according to said command.

25. The updating apparatus set forth in claim 22, wherein a group is defined which includes one or a plurality of said blocks, and said receiver receives information representing which group transferred pixels belong to.

26. A transferring apparatus for transferring to a receiving apparatus image information comprising a plurality of pixels divided into a plurality of blocks, said transferring apparatus comprising:

a storage device for storing said image information;

a transmitter;

a counter for counting the number of changed pixels for each said block; and a controller for determining for each said block whether the count exceeded a predetermined threshold, and for, if said count of a block exceeds said predetermined threshold, instructing said transmitter to transfer information of the pixels which belong to said block stored in said storage device to said receiving apparatus.

27. A transferring apparatus for transferring to a receiving apparatus image information comprising a plurality of pixels divided into a plurality of blocks, said transferring apparatus comprising:

a storage device for storing said image information;

a transmitter;

a counter for count the number of writings to pixels for each said block; and a controller for determining for each said block whether the count exceeds a predetermined threshold, and for, if said count exceeded the predetermined threshold, instructing said transmitter to transfer to said receiving apparatus information of the pixels which belong to said block stored in said storage device.

28. The transferring apparatus set forth in claim 26, wherein said controller further performs a process for incrementing said count if it is determined said count does not exceed the predetermined threshold.

29. The transferring apparatus set forth in claim 27, wherein said controller further performs a process for incrementing said count if it is determined said count does not exceed the predetermined threshold.

30. A storage medium for storing a program for causing a computer to transfer to a second apparatus image information comprising a plurality of pixels divided into blocks, each said block having a size of a predetermined dither matrix, said program comprising the steps of:

holding information representing whether or not content of each said pixel in said image information is changed;

determining in order of a value of a corresponding element in said dither matrix, by referring to said information representing whether or not content of each said pixel is changed, whether or not each said pixel in each said block in said image information is to be transferred to said second apparatus; and transferring to said second apparatus in said order the pixels determined to be transferred.

31. A storage medium for storing a program for causing a computer to transfer to a second apparatus image information comprising a plurality of pixels divided into a plurality of blocks, said program comprising the steps of:

counting the number of changes or writings to pixels in said blocks for each said block;

determining for each said block whether or not the count of a block exceeded a predetermined threshold; and transferring to said second apparatus information of pixels belonging to said block if said count of said block exceeds said predetermined threshold.

* * * * *

UNITED STATES PATENT AND TRADEMARK OFFICE

CERTIFICATE OF CORRECTION

PATENT NO. : 6,559,855 B1
DATED : May 6, 2003
INVENTOR(S) : Kei Kawase et al.

It is certified that error appears in the above-identified patent and that said Letters Patent is hereby corrected as shown below:

Title page,
Item [56], after FOREIGN PATENT DOCUMENTS, insert the following:

-- OTHER PUBLICATIONS

"Frameless Rendering: Double Buffering Considered Harmful" by Gary Bishop, et al., Computer Graphics Proceedings, Annual Conference Series, 1994, pp. 175-176. --

Signed and Sealed this

Twenty-third Day of December, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,559,855 B1
DATED : May 6, 2003
INVENTOR(S) : Kei Kawase et al.

It is certified that error appears in the above-identified patent and that said Letters Patent is hereby corrected as shown below:

Title page,
Item [75], "Setagaya-ka" should read -- Setagaya-ku --

Signed and Sealed this

Twenty-fourth Day of February, 2004

JON W. DUDAS
*Acting Director of the United States Patent and Trademark Office*